US008202105B2

(12) United States Patent
Lord et al.

(10) Patent No.: US 8,202,105 B2
(45) Date of Patent: Jun. 19, 2012

(54) ELECTRICAL CONNECTOR WITH FLOATING CONTACT

(75) Inventors: Hung Wei Lord, Harrisburg, PA (US); George Richard Defibaugh, Harrisburg, PA (US); Donald Everett Wood, Hummelstown, PA (US)

(73) Assignee: Tyco Electronics Corporation, Berwin, PA (US)

( * ) Notice: Subject to any disclaimer, the term of this patent is extended or adjusted under 35 U.S.C. 154(b) by 55 days.

(21) Appl. No.: 12/840,960

(22) Filed: Jul. 21, 2010

(65) Prior Publication Data

US 2012/0021620 A1 Jan. 26, 2012

(51) Int. Cl.
*H01R 13/64* (2006.01)

(52) U.S. Cl. ..... 439/247; 439/541.5; 439/843

(58) Field of Classification Search ..... 439/247, 439/248, 843, 540.1, 541.5, 851, 947
See application file for complete search history.

(56) References Cited

U.S. PATENT DOCUMENTS 4,824,380 A * 4/1989 Matthews ..... 439/78
5,055,055 A * 10/1991 Bakker ..... 439/78
5,201,663 A * 4/1993 Kikuchi et al. ..... 439/83
5,306,168 A * 4/1994 Kunishi et al. ..... 439/248
5,306,169 A * 4/1994 Fukushima et al. ..... 439/248
5,547,400 A 8/1996 Wright
5,807,120 A * 9/1998 Matthews ..... 439/80
6,280,245 B1 * 8/2001 Han ..... 439/541.5

* cited by examiner

*Primary Examiner* — Hae Moon Hyeon

(57) ABSTRACT

An electrical connector is provided for mounting on a printed circuit. The electrical connector includes a housing having a mating face, a mounting face, and an interior cavity. The mounting face is configured to be mounted on the printed circuit. A port extends through the mating face into the interior cavity. The interior cavity is defined by an interior wall of the housing. An electrical contact is held by the housing. The electrical contact includes a mating segment and a mounting segment. The mating segment extends within the interior cavity of the housing. The mating segment includes an exterior surface and a mating interface positioned proximate the port. At least a portion of the mounting segment extends along the mounting face of the housing for engagement with the printed circuit. A clearance exists between the exterior surface of the mating segment and the interior wall of the housing. The mating segment is movable within the interior cavity relative to the housing via the clearance.

20 Claims, 9 Drawing Sheets

ELECTRICAL CONNECTOR WITH FLOATING CONTACT

BACKGROUND OF THE INVENTION

The subject matter described and/or illustrated herein relates generally to electrical connectors, and more particularly, to electrical connectors that are mounted on printed circuits.

Electrical connectors are commonly used to interconnect a wide variety of electrical components. Some electrical connectors are mounted on printed circuits (sometimes referred to as "circuit boards") for electrically connecting the printed circuit to another electrical component. Such electrical connectors include electrical contacts held by a housing that is mounted on the printed circuit. The electrical contacts include mating contacts that engage complementary contacts of the other electrical component or a mating connector thereof. The electrical contacts also include mounting contacts that mount to the printed circuit. For example, the mounting contacts may be surface mount contacts that engage electrical traces and/or electrical pads on a surface of the printed circuit. Another example of the mounting contacts includes pin contacts and/or eye-of-the needle contacts that are received within vias of the printed circuit. Corresponding mating and mounting contacts define different portions of the same electrical path through the electrical connector. The corresponding mating and mounting contacts may be a single integral electrical contact, may engage each other directly, or may be electrically connected to each other via an intermediary component, such as a lead frame, an intermediary contact, and/or the like.

The printed circuit on which the electrical connector is mounted is typically rigidly held by a support structure, for example, within a larger system such as a personal computer, a server, or another electrical device. Accordingly, for at least some known electrical connectors mounted on printed circuits, it may be difficult to align the electrical and mating connectors for mating because only the position and orientation of the mating connector can be manipulated. Specifically, it may be difficult to position and/or orient the mating contacts of the electrical connector relative to the complementary contacts of the mating connector in a manner that enables the mating contacts to mate with the complementary contacts. For example, a mating contact may not mate with a complementary contact if the contacts are aligned off-center relative to each other. Aligning the electrical connector with the mating connector may be especially problematic when the printed circuit is mounted within a tight and/or enclosed space where it may be difficult to manipulate the mating connector and/or see the relative position and orientation of the electrical and mating connectors.

BRIEF DESCRIPTION OF THE INVENTION

In one embodiment, an electrical connector is provided for mounting on a printed circuit. The electrical connector includes a housing having a mating face, a mounting face, and an interior cavity. The mounting face is configured to be mounted on the printed circuit. A port extends through the mating face into the interior cavity. The interior cavity is defined by an interior wall of the housing. An electrical contact is held by the housing. The electrical contact includes a mating segment and a mounting segment. The mating segment extends within the interior cavity of the housing. The mating segment includes an exterior surface and a mating interface positioned proximate the port. At least a portion of the mounting segment extends along the mounting face of the housing for engagement with the printed circuit. A clearance exists between the exterior surface of the mating segment and the interior wall of the housing. The mating segment is movable within the interior cavity relative to the housing via the clearance.

In another embodiment, an electrical connector assembly includes a printed circuit and an electrical connector configured to be mounted on the printed circuit. The electrical connector includes a housing having a mating face, a mounting face, and an interior cavity. The mounting face is configured to be mounted on the printed circuit. A port extends through the mating face into the interior cavity. The interior cavity is defined by an interior wall of the housing. An electrical contact is held by the housing. The electrical contact includes a mating segment and a mounting segment. The mating segment extends within the interior cavity of the housing. The mating segment includes an exterior surface and a mating interface positioned proximate the port. At least a portion of the mounting segment extends along the mounting face of the housing for engagement with the printed circuit. A clearance exists between the exterior surface of the mating segment and the interior wall of the housing. The mating segment is movable within the interior cavity relative to the housing via the clearance.

DETAILED DESCRIPTION OF THE INVENTION

Figure 1:
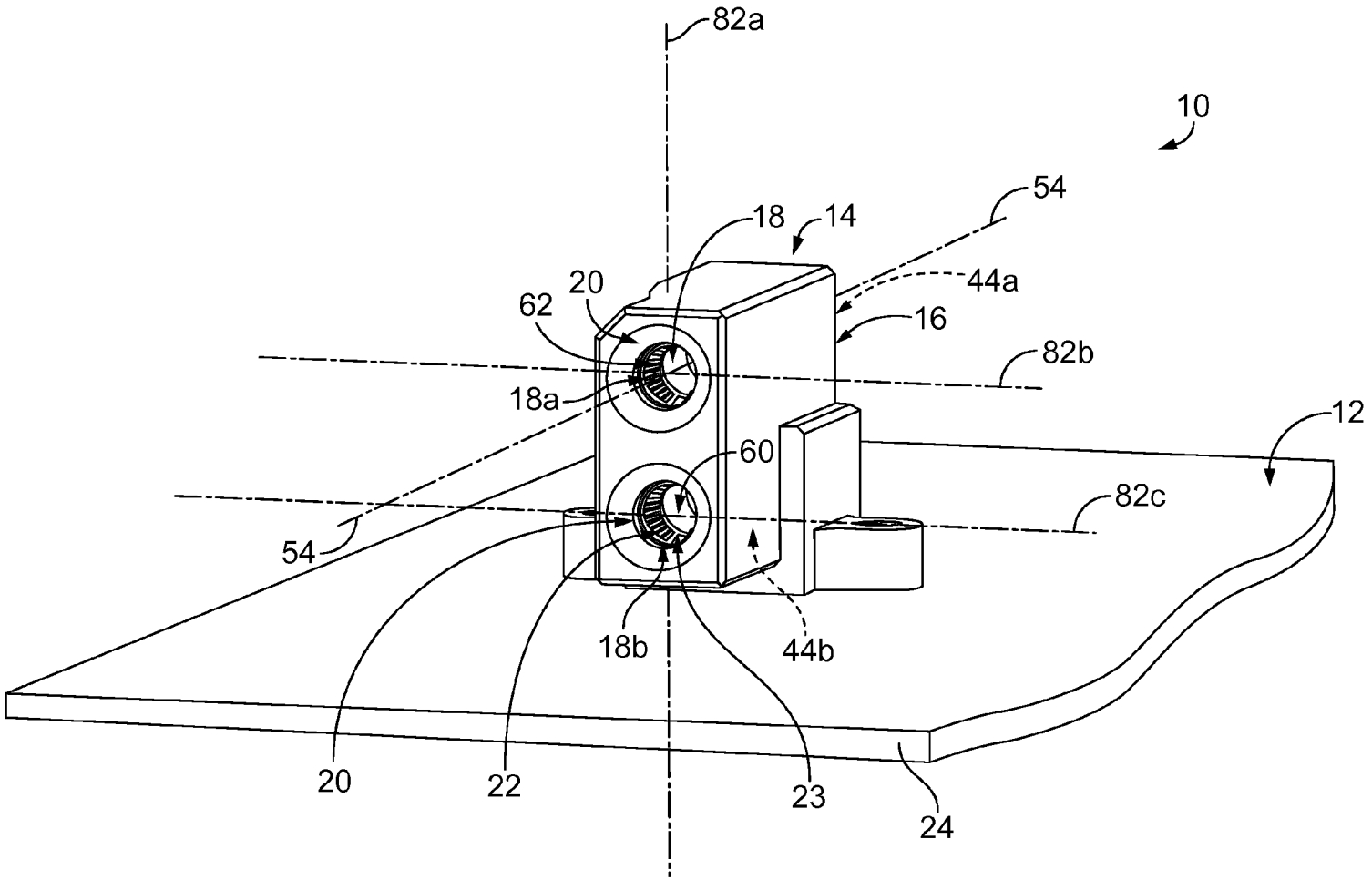
FIG. 1 is a perspective view of an exemplary embodiment of an electrical connector assembly.

FIG. 1 is a perspective view of an exemplary embodiment of an electrical connector assembly 10. The assembly 10 includes a printed circuit 12 and an electrical connector 14 mounted on the printed circuit 12. The electrical connector 14 includes a housing 16 and one or more electrical contacts 18 held by the housing 16. The housing 16 is mounted on the printed circuit 12. The electrical contacts 18 are electrically connected to the printed circuit 12. The housing 16 includes two ports 20 that are configured to receive mating contacts (not shown) of a mating connector (not shown) therein. Mating segments 22 of the electrical contacts 18 include mating interfaces 23 that are positioned proximate corresponding ports 20. When the mating contacts are received within the ports 20, the mating contacts engage the mating segments 22 at the mating interfaces 23 to electrically connect the mating connector to the printed circuit 12. As will be described below, the mating segments 22 are configured to move, or float, relative to the housing 16.

Although the housing 16 is shown as holding two electrical contacts 18*a* and 18*b*, the housing 16 may hold any number of electrical contacts 18. As used herein, the term "printed circuit" is intended to mean any electric circuit in which the conducting connections have been printed or otherwise deposited in predetermined patterns on and/or within an electrically insulating substrate. The printed circuit 12 includes a substrate 24. The substrate 24 may be a flexible substrate or a rigid substrate. The substrate 24 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 24 is a rigid substrate fabricated from epoxy-glass, which is sometimes referred to as a "circuit board". The substrate 24 may include any number of layers. In alternative to the substrate 24, the electrical connector 14 may be mounted on, and electrically connected to, a busbar (not shown), such as, but not limited to, within a power distribution interface and/or the like. The busbar may be any type of busbar, such as, but not limited to, a metallic busbar, a copper busbar, an aluminum busbar, a solid busbar, a laminate busbar, and/or the like. The electrical connector 14 may be electrically connected to the busbar using any process, method, structure, means, and/or the like, such as, but not limited to, being bolted to the busbar, using a compliant press-fit connection, using solder, and/or the like.

Figure 2:
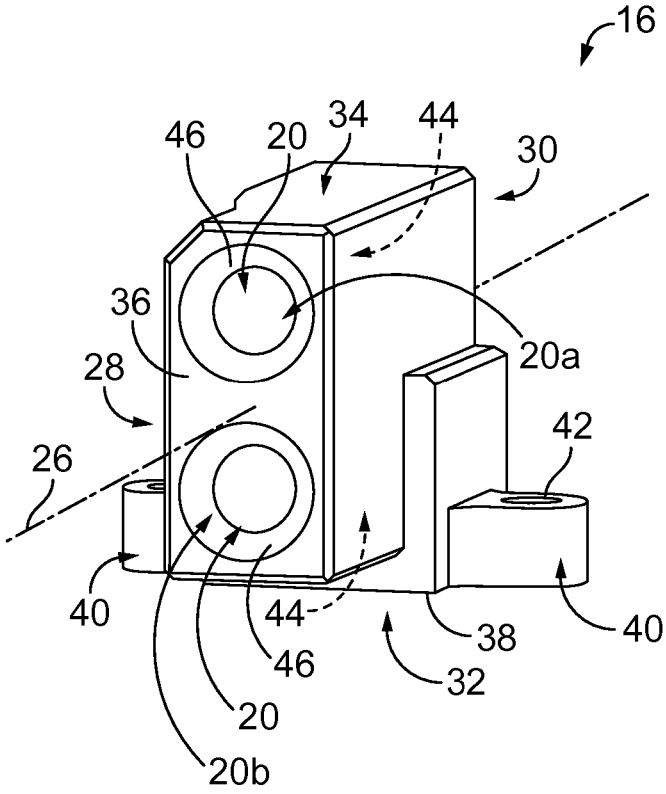
FIG. 2 is a front perspective view of an exemplary embodiment of a housing of the electrical connector assembly shown in FIG. 1.

FIG. 2 is a front perspective view of an exemplary embodiment of the housing 16. The housing 16 extends a length along a central longitudinal axis 26 from a mating end 28 to an opposite end 30. The housing 16 extends a height from a mounting end 32 to an opposite end 34. The mating end 28 of the housing 16 includes a mating face 36, while the mounting end 32 includes a mounting face 38. The mounting face 38 of the housing 16 is configured to be mounted on the printed circuit 12 (FIG. 1). The housing 16 includes optional mounting ears 40 positioned proximate the mounting end 32 for mechanically connecting the housing 16 to the printed circuit 12. Specifically, each mounting ear 40 includes an opening 42 that extends therethrough and receives a threaded and/or other type of fastener (not show) therein. The fasteners engage the printed circuit 12 to mechanically hold the housing 16 on the printed circuit 12. Although two are shown, the housing 16 may include any number of the mounting ears 40.

Interior cavities 44 extend within the housing 16. The ports 20 extend through the mating face 36 and into corresponding interior cavities 44. In the exemplary embodiment, each port 20 is defined by a surface 46 that extends from, and is sloped relative to, the mating face 36. The surface 46 facilitates guiding reception of the corresponding mating contact (not shown) of the mating connector (not shown) within the port 20. Although shown as including both a generally circular and a generally frustoconical shape, each port 20 may additionally or alternatively include any other shape. The exemplary embodiment of the housing 16 includes two ports 20. But, the housing 16 may include any number of ports 20 that each receives any number of mating contacts. The ports 20 may be arranged in any pattern relative to each other, such as, but not limited to, any number of columns and/or rows. In the exemplary embodiment, the mating face 36 of the housing 16 is approximately perpendicular to the mounting face 38. Alternatively, the mating face 36 may extend at any other angle relative to the mounting face 38, such as, but not limited to, approximately parallel.

Figure 3:
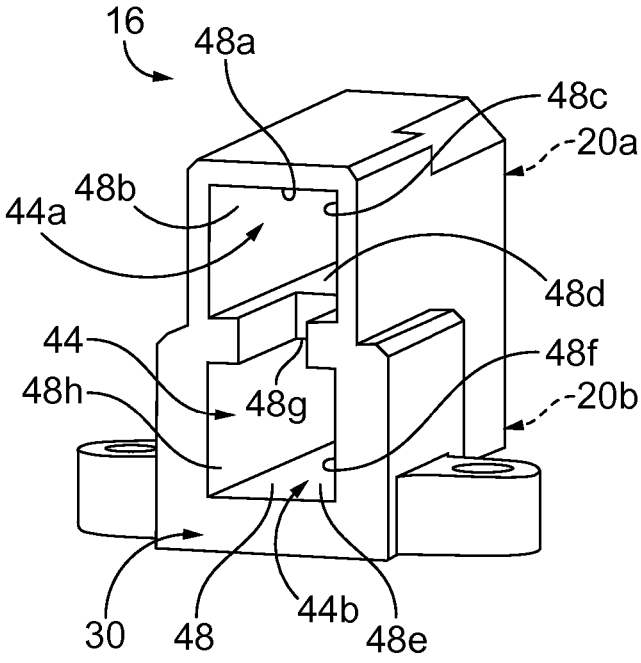
FIG. 3 is a rear perspective view of the housing shown in FIG. 2.

FIG. 3 is a rear perspective view of the housing 16. The housing includes two interior cavities 44*a* and 44*b*. As will be described below, each interior cavity 44*a* and 44*b* is configured to hold a respective one of the electrical contacts 18 (FIGS. 1, 4, 5, 7, and 8) therein. The interior cavities 44*a* and 44*b* are defined by interior walls 48 of the housing 16. Specifically, in the exemplary embodiment, the interior cavity 44*a* is defined by four interior walls 48*a*, 48*b*, 48*c*, and 48*d* of the housing 16, and the interior cavity 44*b* is defined by four interior walls 48*e*, 48*f*, 48*g*, and 48*h* of the housing 16. Each of the interior cavities 44*a* and 44*b* extends a length from a respective one of the ports 20*a* and 20*b* (best seen in FIG. 2) to the end 30 of the housing 16. The interior cavities 44*a* and 44*b* extend through the end 30 and completely through the housing 16 between the respective port 20*a* and 20*b* and the end 30.

Although two interior cavities 44*a* and 44*b* are shown, the housing 16 may include any number of interior cavities 44 that each receives any number of electrical contacts 18 therein and that each communicates with any number of ports 20. Moreover, each interior cavity 44 may be defined by any number of interior walls 48 of the housing 16. In the exemplary embodiment, each of the interior cavities 44*a* and 44*b* includes a generally rectangular shape. But, in addition or alternative to the generally rectangular shape, each of the interior cavities 44 may include any other shape. In some alternative embodiments, one or more of the interior cavities 44 do not extend through the end 30 of the housing 16.

Figure 4:
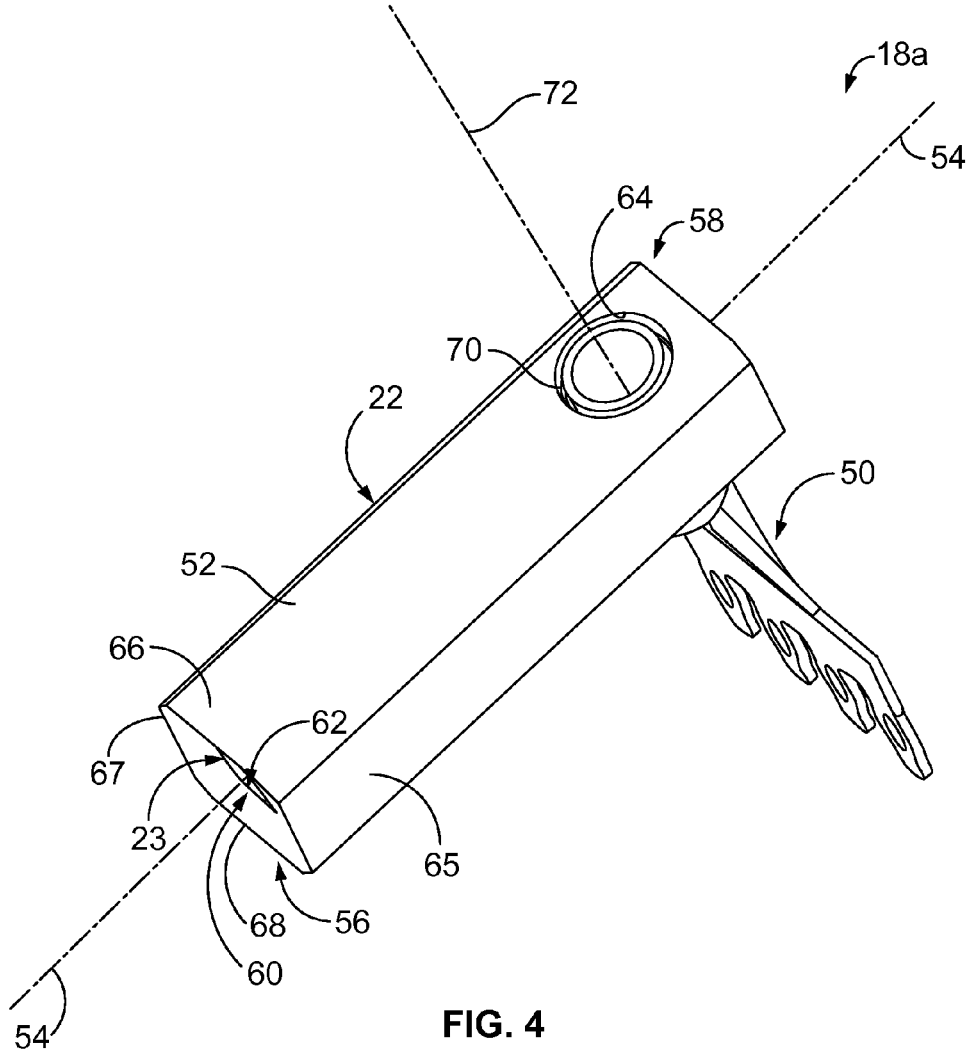
FIG. 4 is a perspective view of an exemplary embodiment of an electrical contact of the electrical connector assembly shown in FIG. 1.

FIG. 4 is a perspective view of an exemplary embodiment of an electrical contact 18*a* of the electrical connector assembly 10 (FIG. 1). The electrical contact 18*a* includes the mating segment 22 and an electrically conductive mounting segment 50. The mounting segment 50 is optionally a discrete component from the mating segment 22 that is engaged with the mating segment 22. The mating segment 22 includes an electrically conductive body 52 that, in the exemplary embodiment, includes four exterior surfaces 65, 66, 67, and 68. The exterior surfaces 65 and 67 are opposite each other, while the exterior surfaces 66 and 68 are opposite each other. The exterior surfaces 65 and 67 each intersect the exterior surfaces 66 and 68, while the exterior surfaces 66 and 68 each intersect the exteriors surfaces 65 and 67. The mating segment 22 extends a length along a central longitudinal axis 54 from an end 56 to an opposite end 58.

Figure 5:
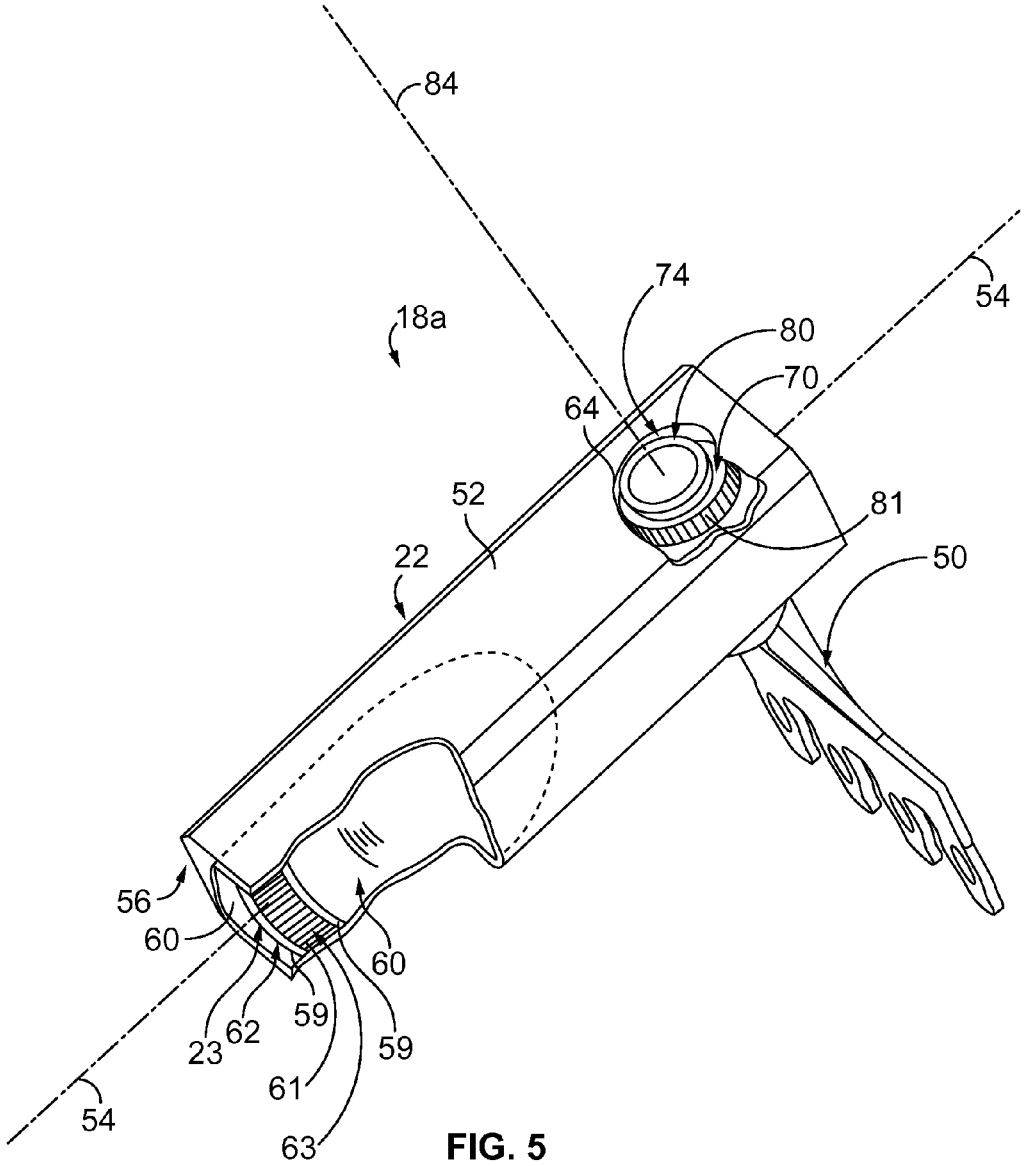
FIG. 5 is a partially broken away perspective view of the electrical contact shown in FIG. 4.

In the exemplary embodiment, the mating interface 23 of the mating segment 22 is defined by a socket 60 that extends into the body 52 of the mating segment 22 through the end 56. FIG. 5 is a partially broken away perspective view of the electrical contact 18*a* illustrating the socket 60. The socket 60 is configured to receive a corresponding one of the mating contacts (not shown) of the mating connector (not shown) therein. Optionally, the mating segment 22 includes a crownband 62 held within the socket 60. The crownband 62 includes a pair of rings 59 and a plurality of spring fingers 61 that extend between, and interconnect, the rings 59. A middle segment 63 of each of the spring fingers 61 is biased to extend radially inwardly relative to the central longitudinal axis 54. When the mating contact of the mating connector is received within the socket 60, the mating contact engages the crownband 62 to electrically connect the mating contact to the mating segment 22 of the electrical contact 18*a*. Specifically, the mating contact engages the spring fingers 61 of the crownband 62 and forces the spring fingers 61 radially outward against the bias thereof.

Referring again to FIG. 4, the mating segment 22 includes an optional opening 64 for engagement with the mounting segment 50. In the exemplary embodiment, the opening 64 is positioned proximate the end 58 of the mating segment 22 and extends completely through the body 52 of the mating segment 22. Specifically, the opening 64 extends through the opposite exterior surfaces 66 and 68 of the mating segment 22 and completely through the mating segment 22 therebetween. Optionally, a crownband 70 is held within the opening 64 in engagement with the body 52 of the mating segment 22. As will be described below, the crownband 70 engages the mounting segment 50 to electrically connect the mating and mounting segments 22 and 50, respectively, of the electrical contact 18*a*. Although shown as including a generally cylindrical shape, the opening 64 may additionally or alternatively include any other shape. In some alternative embodiments, the opening 64 may be positioned at any other location along the length of the mating segment 22 than proximate the end 58. Moreover, the opening 64 may alternatively extend only partially through the body 52 of the mating segment 22, for example through the exterior surface 68 but not through the exterior surface 66.

In the exemplary embodiment, the mating segment 22 includes a generally rectangular shape along the length thereof. But, in addition or alternative to the generally rectangular shape, the mating segment 22 may include any other shape. Similarly, in addition or alternative to the generally cylindrical shape shown, the socket 60 may include any other shape that enables the socket 60 to receive the mating contact of the mating connector therein. In some alternative embodiments, the mating segment 22 does not include the crownband 62. In addition or alternative to the crownband 62, the mating contact of the mating connector may engage the body 52 of the mating segment 22 directly, and/or may engage any other component (not shown) held in the socket 60, to electrically connect the mating segment 22 to the mating contact. In alternative to the socket 60, the mating segment 22 may include a pin, a plug, and/or the like that is received within a socket (not shown) of the mating contact of the mating connector. In some alternative embodiments, the mounting segment 50 is integrally formed with the mating segment 22.

Figure 6:
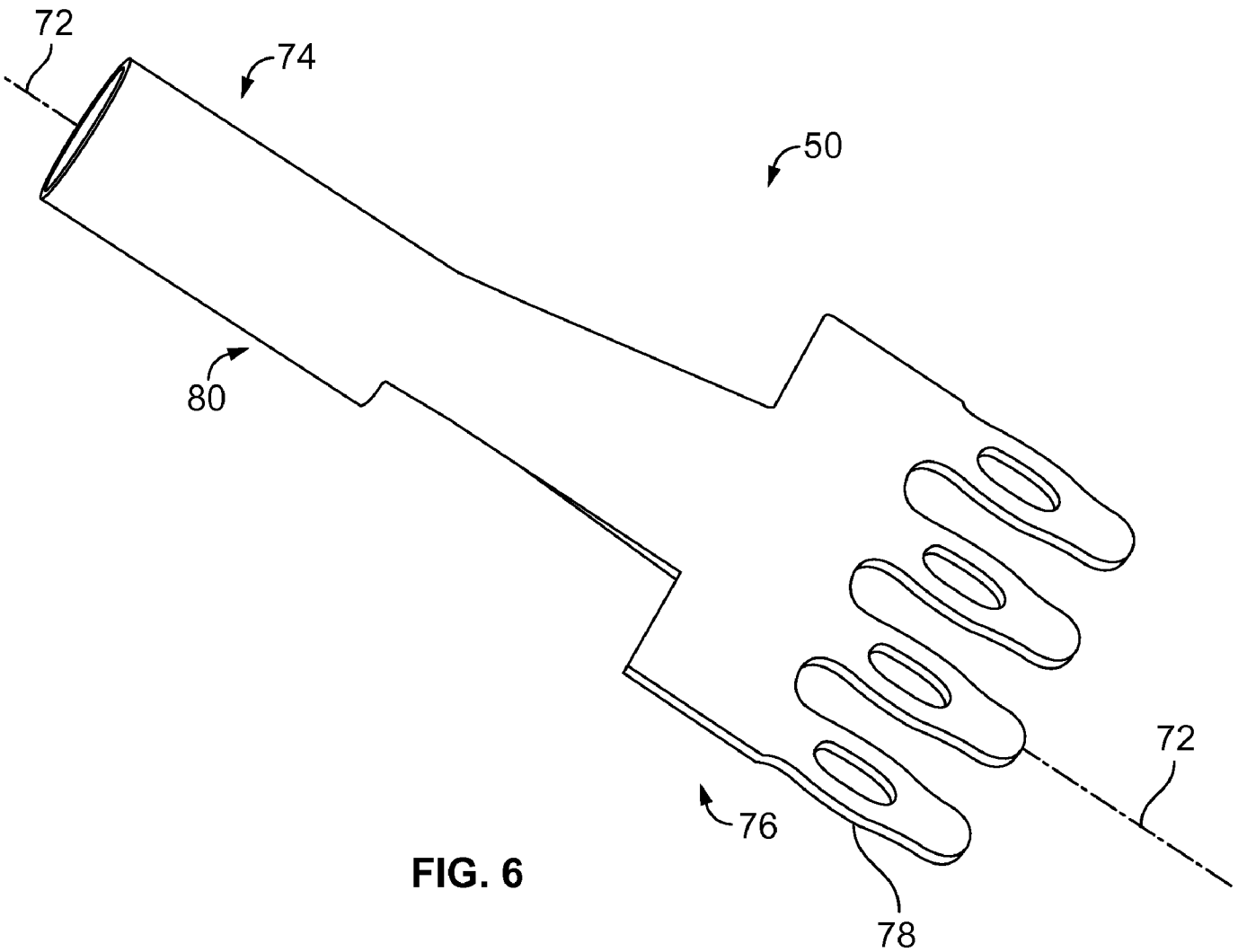
FIG. 6 is a perspective view of an exemplary embodiment of a mounting segment of the electrical contact shown in FIGS. 4 and 5.

FIG. 6 is a perspective view of an exemplary embodiment of the mounting segment 50 of the electrical contact 18*a* (FIGS. 1, 4, 5, 7, and 8). The mounting segment 50 extends a length along a central longitudinal axis 72 from an engagement end 74 to a mounting end 76. The mounting end 76 includes a plurality of individual contacts 78 for electrically connecting the mounting segment 50 to the printed circuit 12 (FIG. 1). Specifically, the individual contacts 78 engage electrically conductors (not shown) of the printed circuit 12. The engagement end 74 includes a barrel 80 that is configured to be received within the opening 64 (FIGS. 4 and 5) of the mating segment 22 (FIGS. 1, 4, 5, 7, and 8). When received within the opening 64, the barrel 80 engages the crownband 70 (FIGS. 4 and 5) to electrically connect the mounting segment 50 to the body 52 (FIGS. 4 and 5) of the mating segment 22.

Although shown as including a cylindrical shape, the barrel 80 may additionally or alternatively include any other shape for being received within an opening 64 that includes any shape and/or for engaging any other portion (and/or component) of the mating segment 22. In the exemplary embodiment, the individual contacts 78 of the mounting segment 50 are eye-of-the needle contacts that are configured to be received within vias (not shown) of the printed circuit 12 to electrically connect the mounting segment 50 to the printed circuit 12. In addition or alternatively, each of the individual contacts 78 could include any structure other than an eye-of-the needle structure. For example, each individual contact 78 could be, but is not limited to, a pad, a pin, and/or any other structure for engaging vias and/or any other type of electrical conductor of the printed circuit 12, such as, but not limited to, an electrical trace, and electrical pad, and/or the like. Although four are shown, the mounting end 76 of the mounting segment 50 may include any number of the individual contacts 78. The mounting segment 50 may be fabricated using any process, method, structure, means, and/or the like. In some embodiments, the mounting segment 50 is stamped and formed from a sheet of material.

Referring again to FIG. 5, the engagement end 74 of the mounting segment 50 is engaged with the mating segment 22. Specifically, the barrel 80 of the mounting segment 50 is received within the opening 64 and engaged with the crownband 70 of the mating segment 22. Specifically, the barrel 80 engages spring fingers 81 of the crownband 70 and forces the spring fingers 81 radially outward against the bias thereof. Engagement between the crownband 70 and the barrel 80 and engagement between the crownband 70 and the body 52 of the mating segment 22 electrically connects the mating segment 22 to the mounting segment 50. Further, resilience of the spring fingers 81 of the crownband 70 enables the mating segment 22 to move relative to the mounting segment 50, as will be described in more detail below. In some alternative embodiments, the mating segment 22 does not include the crownband 70. In addition or alternative to the crownband 70, the barrel 80 may engage the body 52 of the mating segment 22 directly, and/or may engage any other component (not shown) held in the opening 64, to electrically connect the mating segment 22 to the mounting contact 50. Moreover, the mating segment 22 may not include the opening 64 in some alternative embodiments. When the opening 64 is not included, the barrel 80 may engage any other portion and/or component of the mating segment 22 to electrically connect the mating segment 22 to the mounting contact 50.

Referring again to FIG. 4, when engaged together, the length of the mating segment 22 extends approximately perpendicular to the length of the mounting segment 50. Specifically, the central longitudinal axis 54 of the mating segment 22 extends approximately perpendicular to the central longitudinal axis 72 of the mounting segment 50. Alternatively, when the mating and mounting segments 22 and 50, respectively, are engaged together, the axes 54 and 72 may extend at any other angle relative to each other, such as, but not limited to, approximately parallel.

Except for a length of the mounting segment 50, the electrical contact 18*b* is substantially similar to the electrical contact 18*a* and therefore will not be described in more detail herein.

Figure 7:
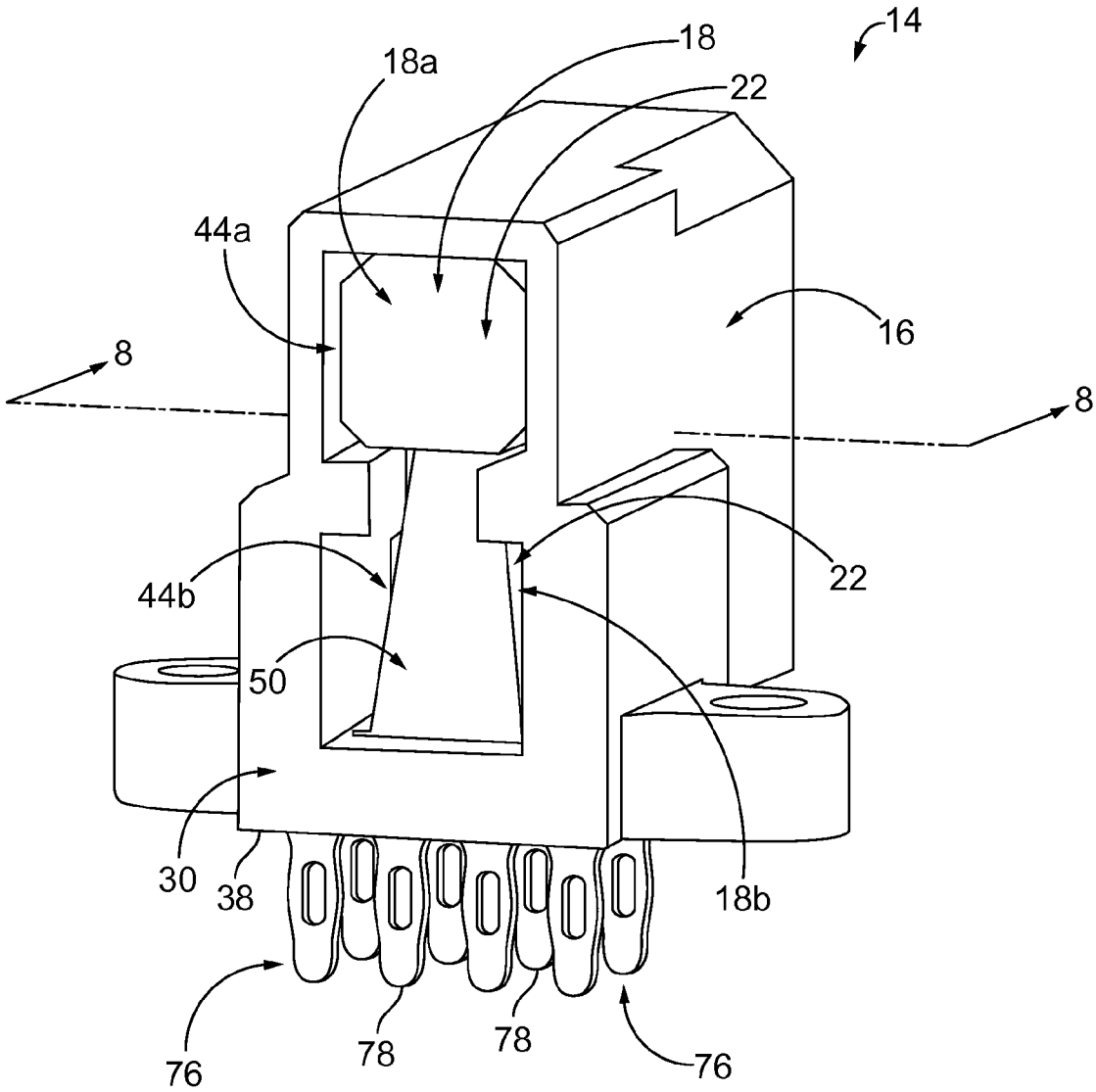
FIG. 7 is a rear perspective view of an exemplary embodiment of an electrical connector of the electrical connector assembly shown in FIG. 1.

FIG. 7 is a rear perspective view of an exemplary embodiment of the electrical connector 14. The electrical contacts 18*a* and 18*b* are received within the interior cavities 44*a* and 44*b*, respectively. In the exemplary embodiment, the electrical contacts 18*a* and 18*b* are loaded into the interior cavities 44*a* and 44*b*, respectively, through the end 30 of the housing 16. The mounting segments 50 of the electrical contacts 18*a* and 18*b* extend from the mating segments 22 such that the mounting end 76 extends through the mounting face 38 of the housing 16. Specifically, the individual contacts 78 of the mounting segments 50 extend outwardly from the mounting face 38 of the housing 16 for engagement with the printed circuit 12 (FIG. 1). A portion of each of the mounting segments 50 thereby extends along the mounting face 38 of the housing 16.

Referring again to FIG. 1, the mating interfaces 23 of the mating segments 22 of the electrical contacts 18*a* and 18*b* are positioned proximate the corresponding ports 20. Specifically, the socket 60 of each mating segment 22 is aligned with the corresponding port 20 for reception of the corresponding mating contact (not shown) of the mating connector (not shown) therein. As can be seen in FIG. 1, the crownband 62 of each mating segment is positioned proximate the corresponding port 20 for engagement with the corresponding mating contact. When the mating connector is mated with the electrical connector 14, the electrical contacts 18 electrically connect the mating contacts of the mating connector to the printed circuit. Specifically, engagement between the mating contacts and the mating segments 22 and engagement between the individual contacts 78 (FIGS. 6 and 7) and the printed circuit 12 electrically connects the mating connector to the printed circuit 12. Each of the electrical contacts 18 may be configured to transmit electrical power, data signals, and/or ground between the mating connector and the printed circuit 12.

In the exemplary embodiment, the central longitudinal axes 54 of the mating segments 22 of the electrical contacts 18 extend approximately parallel to the printed circuit 12 when the electrical connector 14 is mounted on the printed circuit 12. Alternatively, the central longitudinal axis 54 of one or more of the mating segments 22 extends at any other angle than approximately parallel relative to the printed circuit 12 when the electrical connector 14 is mounted on the printed circuit 12, such, as but not limited to, approximately perpendicular. Although shown as being arranged in a single column relative to the printed circuit 12, the ports 20 and the mating segments 22 of the electrical contacts 18 may be arranged in any pattern, such as, but not limited to, any number of columns and/or rows.

Figure 8:
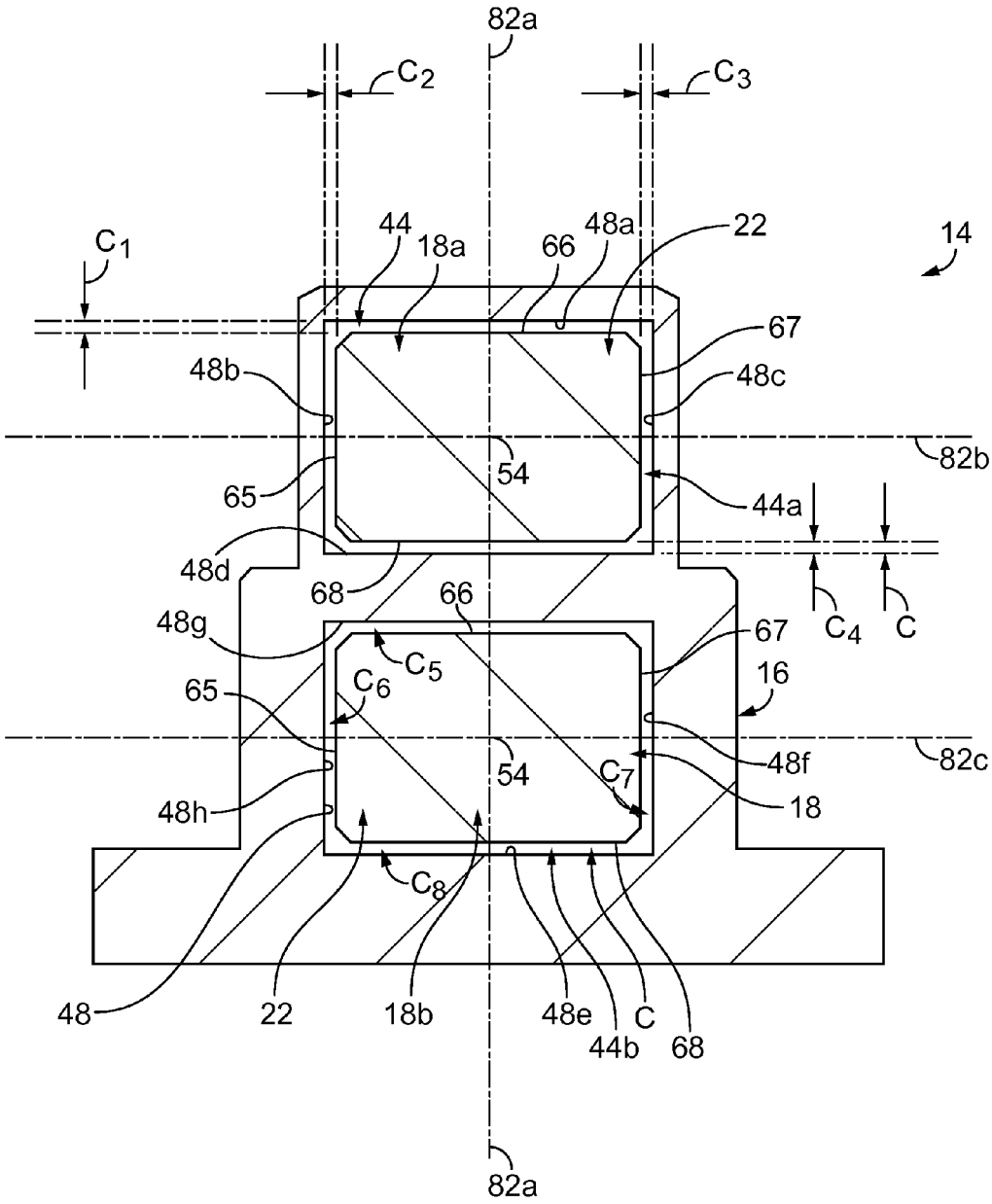
FIG. 8 is a cross-sectional view of the electrical connector shown in FIG. 7 taken along line 8-8 of FIG. 7.

FIG. 8 is a cross sectional view of the electrical connector 14 taken along line 8-8 of FIG. 7. As briefly described above, the mating segments 22 of the electrical contacts 18 are configured to move, or float, relative to the housing 16. Specifically, the mating segments 22 of the electrical contacts 18*a* and 18*b* are configured to move within the respective interior cavity 44*a* and 44*b* relative to the housing 16. The mating segments 22 are movable within the interior cavities 44 relative to the housing 16 via a clearance C that exists between at least one of the exterior surfaces 65, 66, 67, and 68 of the mating segment 22 and at least one of the interior walls 48 of the housing 16. For example, in the exemplary embodiment shown in FIG. 8, each of the mating segments 22 is disposed in a central position within its respective cavity 44. In this position, a clearance $C_1$ exists between the exterior surface 66 of the mating segment 22 of the electrical contact 18*a* and the interior wall 48*a* of the housing 16. Similarly, clearances $C_2$, $C_3$, and $C_4$ exist between the exterior surfaces 65, 67, and 68 of the mating segment 22 of the electrical contact 18*a* and the interior walls 48*b*, 48*c*, and 48*d* of the housing 16, respectively. The mating segment 22 of the electrical contact 18*a* is movable relative to the interior walls 48*a-d* of the housing 16 via the clearances $C_1$-$C_4$. For example, via clearances $C_1$-$C_4$, the mating segment 22 of the electrical contact 18*a* is movable within the interior cavity 44*a* relative to the housing 16 along float axes 82*a* and 82*b*. The float axes 82*a* and 82*b* are perpendicular to each other and to the central longitudinal axis 54 of the mating segment 22 of the electrical contact 18*a*. In fact, the clearances $C_1$-$C_4$ enable the mating segment 22 of the electrical contact 18*a* to move within the interior cavity 44*a* along any axis that is perpendicular to the central longitudinal axis 54 of the mating segment 22 of the electrical contact 18*a*.

Similar to the electrical contact 18*a*, in the exemplary embodiment, the mating segment 22 of the electrical contact 18*b* is movable along any axis that is perpendicular to the central longitudinal axis 54 of the mating segment 22 of the electrical contact 18*b*. For example, in the exemplary embodiment, the mating segment 22 of the electrical contact 18*b* is movable along the float axis 82*a* and along a float axis 82*c*. Specifically, clearances $C_5$-$C_8$ exist between the exterior surfaces 66, 65, 67, and 68 of the mating segment 22 of the electrical contact 18*b* and the interior walls 48*g*, 48*h*, 48*f*, and 48*e* of the housing 16, respectively. The float axes 82*a* and 82*c* are perpendicular to each other and to the central longitudinal axis 54 of the mating segment 22 of the electrical contact 18*b*.

Figure 9:
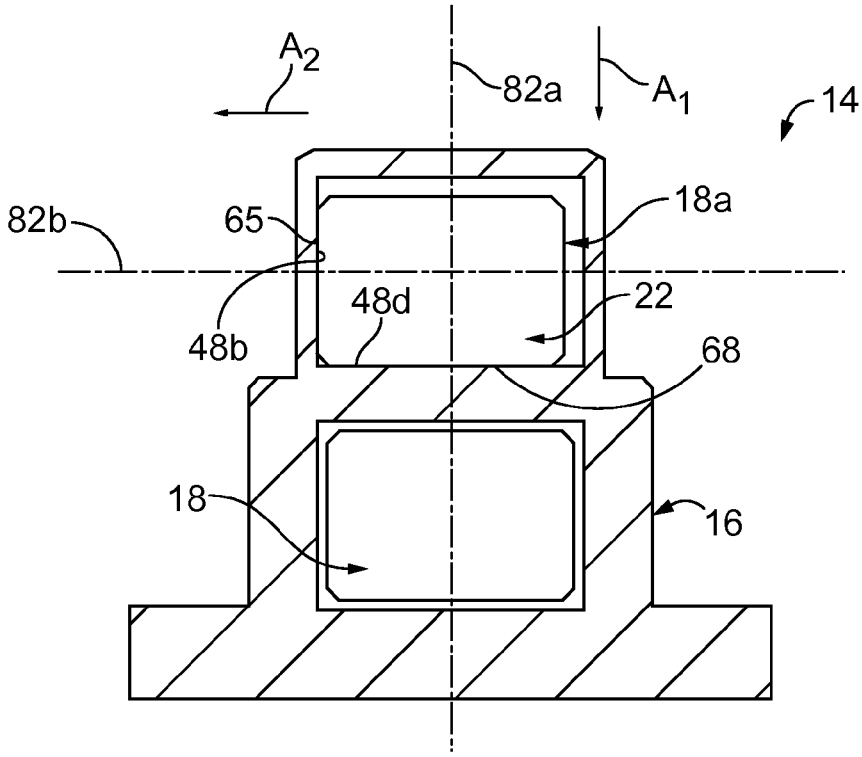
FIG. 9 is another cross-sectional view of the electrical connector shown in FIG. 7 illustrating exemplary movement of an exemplary embodiment of a mating segment of the electrical contact shown in FIGS. 4 and 5.

FIG. 9 is a cross sectional view of the electrical connector 14 illustrating an exemplary movement of the mating segment 22 of the electrical contact 18*a* along the float axes 82*a* and 82*b*. The mating segment 22 of the electrical contact 18*a* has moved from the central position shown in FIG. 8 to a position wherein the exterior surfaces 65 and 68 are engaged with the interior walls 48*b* and 48*d*, respectively, of the housing 16. Specifically, the mating segment 22 of the electrical contact 18*a* has moved along the float axis 82*a* in the direction of the arrow $A_1$ from the position shown in FIG. 8 to the position shown in FIG. 9. The clearance $C_4$ (FIG. 8) between the exterior surface 68 and the interior wall 48*d* that exists when the mating segment 22 is in the central position shown in FIG. 8 enabled movement of the mating segment 22 along the float axis 82*a* in the direction $A_1$. In the position shown in FIG. 9, the mating segment 22 of the electrical contact 18*a* has moved a distance along the float axis 82*a* that is equal to the clearance $C_4$ shown in FIG. 8. The exterior surface 68 of the mating segment 22 is thereby engaged with the interior wall 48*d* of the housing 16.

In FIG. 9, the mating segment 22 of the electrical contact 18*a* has also moved along the float axis 82*b* in the direction of the arrow $A_2$ from the position shown in FIG. 8 to the position shown in FIG. 9. The clearance $C_2$ (FIG. 8) between the exterior surface 65 and the interior wall 48*b* that exists when the mating segment 22 is in the central position shown in FIG. 8 enabled movement of the mating segment 22 along the float axis 82*b* in the direction $A_2$. In the position shown in FIG. 9, the mating segment 22 of the electrical contact 18*a* has moved a distance along the float axis 82*b* that is equal to the clearance $C_2$ shown in FIG. 8. The exterior surface 65 of the mating segment 22 is thereby engaged with the interior wall 48*b* of the housing 16.

Figure 10:
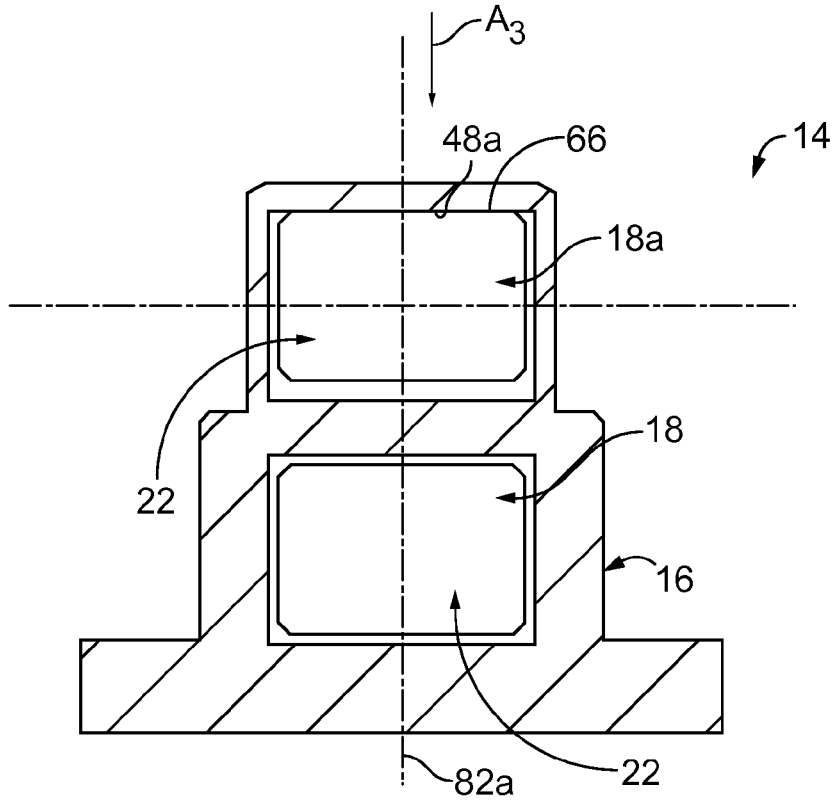
FIG. 10 is a cross-sectional view of the electrical connector shown in FIG. 7 illustrating another exemplary movement of the mating segment of the electrical contact shown in FIGS. 4 and 5.

FIG. 10 is a cross sectional view of the electrical connector 14 illustrating another exemplary movement of the mating segment 22 of the electrical contact 18*a*. The mating segment 22 of the electrical contact 18*a* has moved from the position shown in FIG. 8 to a position wherein the exterior surface 66 is engaged with the interior wall 48*a* of the housing 16. Specifically, the mating segment 22 of the electrical contact 18*a* has moved along the float axis 82*a* in the direction of the arrow $A_3$ from the central position shown in FIG. 8 to the position shown in FIG. 10. The clearance $C_1$ (FIG. 8) between the exterior surface 66 and the interior wall 48*a* that exists when the mating segment 22 is in the central position shown in FIG. 8 enabled movement of the mating segment 22 along the float axis 82*a* in the direction $A_3$. In the position shown in FIG. 10, the mating segment 22 of the electrical contact 18*a* has moved a distance along the float axis 82*a* that is equal to the clearance $C_1$ shown in FIG. 8. The exterior surface 66 of the mating segment 22 is thereby engaged with the interior wall 48*a* of the housing 16.

Figure 11:
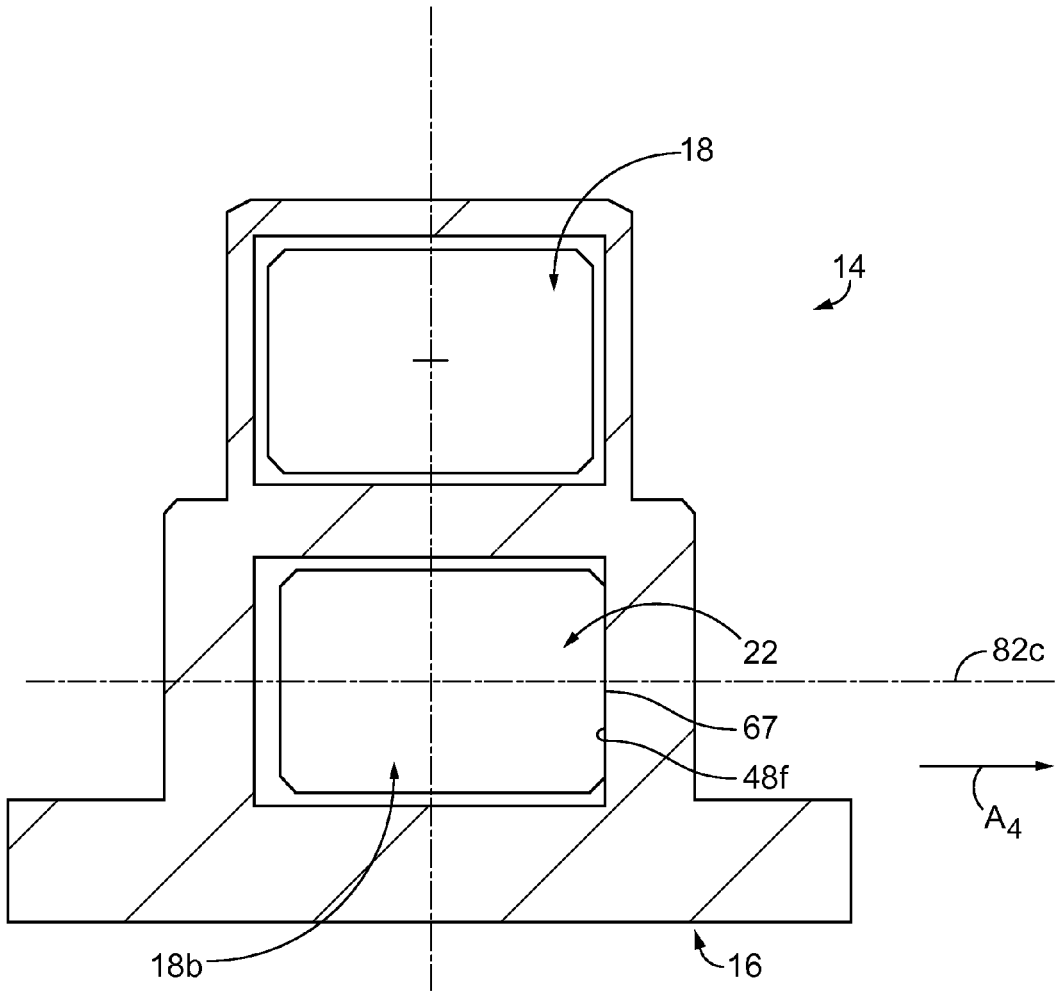
FIG. 11 is a cross-sectional view of the electrical connector shown in FIG. 7 illustrating exemplary movement of an exemplary embodiment of a mating segment of another electrical contact of the electrical connector assembly shown in FIG. 1.

FIG. 11 is a cross sectional view of the electrical connector 14 illustrating an exemplary movement of the mating segment of the electrical contact 18*b*. The mating segment 22 of the electrical contact 18*b* has moved from the position shown in FIG. 8 to a position wherein the exterior surface 67 is engaged with the interior wall 48*f* of the housing 16. Specifically, the mating segment 22 of the electrical contact 18*b* has moved along the float axis 82*c* in the direction of the arrow $A_4$ from the central position shown in FIG. 8 to the position shown in FIG. 11. The clearance $C_7$ (FIG. 8) between the exterior surface 67 and the interior wall 48*f* that exists when the mating segment 22 is in the central position shown in FIG. 8 enabled movement of the mating segment 22 along the float axis 82*c* in the direction $A_4$. In the position shown in FIG. 11, the mating segment 22 of the electrical contact 18*b* has moved a distance along the float axis 82*c* that is equal to the clearance $C_7$ shown in FIG. 8. The exterior surface 67 of the mating segment 22 is thereby engaged with the interior wall 48*f* of the housing 16.

Referring again to FIG. 8, in alternative embodiments, the mating segment 22 of the electrical contact 18*a* may only have some of the clearances $C_1$-$C_4$. Specifically, the mating segment 22 of the electrical contact 18*a* may have any number of clearances between any number of the exterior surfaces 65, 66, 67, and 68 and any number of the corresponding interior walls 48*b*, 48*a*, 48*c*, and 48*d* of the housing 16 so long as the clearance(s) enables the mating segment 22 to move along at least one axis that is perpendicular to the central longitudinal axis 54. Similarly, the mating segment 22 of the electrical contact 18*b* may only have some of the clearances $C_5$-$C_8$. The mating segment 22 of the electrical contact 18*b* may have any number of clearances between any number of the exterior surfaces 66, 65, 67, and 68 and any number of the corresponding interior walls 48*g*, 48*h*, 48*f*, and 48*e* of the housing 16 so long as the clearance(s) enables the mating segment 22 to move along at least one axis that is perpendicular to the central longitudinal axis 54. For example, in some embodiments, the mating segment 22 of the electrical contact 18*a* only includes the clearance $C_1$ and/or $C_4$, such that the mating segment 22 is movable along the float axis 82*a* but not along the float axis 82*b*. Similarly, and for example, in some embodiments the mating segment 22 of the electrical contact 18*a* only includes the clearance $C_2$ and/or $C_3$, such that the mating segment 22 is movable along the float axis 82*b* but not along the float axis 82*a*. The clearances $C_{1\text{-}8}$ may each have any value that enables any amount of movement of the mating segment 22 along any axis that is perpendicular to the central longitudinal axis 54. The clearances $C_{1\text{-}8}$ have been exaggerated in FIG. 8 for illustrative purposes only.

The clearances $C_{1\text{-}8}$ enable the mating segments 22 to move relative to the corresponding mating contact of the mating connector during mating therewith, which facilitates aligning the mating interface 23 with the mating contact during mating. For example, movement of the mating segment 22 relative to the corresponding mating contact may facilitate aligning the central longitudinal axis 54 of the mating segment 22 with a central longitudinal axis (not shown) of the mating contact during mating. Moreover, and for example, movement of the mating segment 22 relative to the corresponding mating contact may facilitate aligning the socket 60 of the mating segment 22 with the pin, plug, and/or the like of the mating contact. The resilience of the spring fingers 61 of the crownband 62 may facilitate alignment of the mating segments 22 with the corresponding mating contact during mating of the electrical connector 14 with the mating connector. Specifically, the resilience of the spring fingers 61 of the crownband 62 may enable the mating segment of the electrical contact 18*a* to be mated with the corresponding mating contact even when the mating contact is positioned off-center relative to the mating segment 22. Moreover, the resilience of the spring fingers 81 of the crownband 70 may enable the mating segment 22 to move relative to the mounting segment 50 of the electrical contact 18 during movement of the mating segment 22 relative to the housing 16. In some embodiments, the mounting segment 50 of the electrical contact 18*a* may move along a central longitudinal axis 84 (FIG. 5) of the opening 64 (FIGS. 5 and 6), relative to the crownband 70 if included and the housing 16, during movement of the mating segment 22 relative to the housing 16.

Although the mating segments 22 of each of the electrical contacts 18*a* and 18*b* are shown and described herein as moving within the respective interior cavity 44*a* and 44*b* of the housing 16, alternatively, one of the mating segments 22 does not move within the corresponding interior cavity 44*a* or 44*b* of the housing 16.

The embodiments described and/or illustrated herein may provide an electrical connector that is more easily matable with a mating connector than at least some known electrical connectors. For example, the embodiments described and/or illustrated herein may provide an electrical contact that is more easily matable with a mating contact than at least some known electrical contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mounting on a printed circuit, said electrical connector comprising:

a housing having a mating face, a mounting face, and an interior cavity, the mounting face being configured to be mounted on the printed circuit, a port extending through the mating face into the interior cavity, the interior cavity being defined by an interior wall of the housing;

an electrical contact held by the housing, the electrical contact comprising a mating segment and a mounting segment, the mating segment extending a length along a central longitudinal axis of the mating segment, the mating segment extending within the interior cavity of the housing, the mating segment comprising an exterior surface and a mating interface positioned proximate the port, the mating segment being configured to mate with a mating contact that extends a length along a central longitudinal axis of the mating contact, at least a portion of the mounting segment extending along the mounting face of the housing for engagement with the printed circuit; and a clearance between the exterior surface of the mating segment and the interior wall of the housing, the mating segment being movable within the interior cavity relative to the housing via the clearance, the mating segment being movable via the clearance relative to the mating contact for aligning the central longitudinal axes of the mating segment and the mating contact.

2. The connector according to claim 1, wherein the interior wall of the housing comprises two walls that intersect each other, the clearance existing between the exterior surface of the mating segment and each of the two walls, wherein the mating segment is movable relative to each of the two walls via the clearance.

3. The connector according to claim 1, wherein the mating interface of the mating segment of the electrical contact comprises a socket configured to receive a mating contact of a mating connector therein, a crownband being held within the socket and positioned to engage the mating contact when the mating contact is received within the socket.

4. The connector according to claim 1, wherein the mounting segment of the electrical contact is discrete from the mating segment, the mounting segment being engaged with the mating segment.

5. The connector according to claim 1, wherein the mounting segment of the electrical contact is discrete from the mating segment, the mating segment comprising an opening, the mounting segment extending a length from an engagement end to a mounting end, the engagement end being received within the opening and engaged with the mating segment.

6. The connector according to claim 1, wherein the mounting segment of the electrical contact is discrete from the mating segment, the mating segment comprising a crownband, the mounting segment extending a length from an engagement end to a mounting end, the engagement end being engaged with the crownband.

7. The connector according to claim 1, wherein the mounting segment of the electrical contact is discrete from the mating segment, the mounting segment being engaged with the mating segment, the mating segment moving relative to the mounting segment when the mating segment moves relative to the housing.

8. The connector according to claim 1, wherein the electrical contact is configured to conduct electrical power.

9. The connector according to claim 1, wherein the mating interface of the mating segment of the electrical contact comprises a socket configured to receive a mating contact of a mating connector therein.

10. The connector according to claim 1, wherein the mating segment of the electrical contact extends a length along a central longitudinal axis of the mating segment, the central longitudinal axis of the mating segment extending approximately parallel to the printed circuit when the electrical connector is mounted on the printed circuit.

11. The connector according to claim 1, wherein the mating segment of the electrical contact extends a length that is approximately perpendicular to a length of the mounting segment.

12. An electrical connector for mounting on a printed circuit, said electrical connector comprising:

a housing having a mating face, a mounting face, and an interior cavity, the mounting face being configured to be mounted on the printed circuit, a port extending through the mating face into the interior cavity, the interior cavity being defined by an interior wall of the housing;

an electrical contact held by the housing, the electrical contact comprising a mating segment and a mounting segment, wherein the mating segment of the electrical contact extends a length along a central longitudinal axis of the mating segment, the mating segment extending within the interior cavity of the housing, the mating segment comprising an exterior surface and a mating interface positioned proximate the port, at least a portion of the mounting segment extending along the mounting face of the housing for engagement with the printed circuit; and a clearance between the exterior surface of the mating segment and the interior wall of the housing, the mating segment being movable within the interior cavity relative to the housing via the clearance, the mating segment being movable via the clearance along two float axes that are perpendicular to each other and to the central longitudinal axis of the mating segment.

13. An electrical connector assembly comprising:

a printed circuit; and an electrical connector configured to be mounted on the printed circuit, the electrical connector comprising:

a housing having a mating face, a mounting face, and an interior cavity, the mounting face being configured to be mounted on the printed circuit, a port extending through the mating face into the interior cavity, the interior cavity being defined by at an interior wall of the housing, wherein the interior wall of the housing comprises two walls that intersect each other;

an electrical contact held by the housing, the electrical contact comprising a mating segment and a mounting segment, the mating segment extending within the interior cavity of the housing, the mating segment comprising an exterior surface and a mating interface positioned proximate the port, at least a portion of the mounting segment extending along the mounting face of the housing for engagement with the printed circuit; and a clearance between the exterior surface of the mating segment and the interior wall of the housing, the mating segment being movable within the interior cavity relative to the housing via the clearance, the clearance existing between the exterior surface of the mating segment and each of the two walls, wherein the mating segment is movable relative to each of the two walls via the clearance.

14. The assembly according to claim 13, wherein the mating segment of the electrical contact extends a length along a central longitudinal axis of the mating segment, the mating segment being movable via the clearance along two float axes that are perpendicular to each other and to the central longitudinal axis of the mating segment.

15. The assembly according to claim 13, wherein the mating interface of the mating segment of the electrical contact comprises a socket configured to receive a mating contact of a mating connector therein, a crownband being held within the socket and positioned to engage the mating contact when the mating contact is received within the socket.

16. The assembly according to claim 13, wherein the mounting segment is discrete from the mating segment, the mounting segment being engaged with the mating segment.

17. The assembly according to claim 13, wherein the mounting segment of the electrical contact is discrete from the mating segment, the mating segment comprising an opening and a crownband held within the opening, the mounting segment extending a length from an engagement end to a mounting end, the engagement end being received within the opening and engaged with the crownband.

18. The assembly according to claim 13, wherein the electrical contact is configured to conduct electrical power.

19. An electrical connector for mounting on a printed circuit, said electrical connector comprising:

a housing having a mating face, a mounting face, and an interior cavity, the mounting face being configured to be mounted on the printed circuit, a port extending through the mating face into the interior cavity, the interior cavity being defined by an interior wall of the housing;

an electrical contact held by the housing, the electrical contact comprising a mating segment and a mounting segment, the mating segment extending a length along a central longitudinal axis of the mating segment, the mating segment extending within the interior cavity of the housing, the mating segment comprising an exterior surface and a mating interface positioned proximate the port, at least a portion of the mounting segment extending along the mounting face of the housing for engagement with the printed circuit; and a clearance between the exterior surface of the mating segment and the interior wall of the housing, the mating segment being movable within the interior cavity relative to the housing via the clearance, the mating segment being movable via the clearance along a float axis that is perpendicular to the central longitudinal axis of the mating segment.

20. An electrical connector for mounting on a printed circuit, said electrical connector comprising:

a housing having a mating face, a mounting face, and an interior cavity, the mounting face being configured to be mounted on the printed circuit, a port extending through the mating face into the interior cavity, the interior cavity being defined by opposing interior wall of the housing;

an electrical contact held by the housing, the electrical contact comprising a mating segment and a mounting segment, the mating segment extending within the interior cavity of the housing, the mating segment comprising an exterior surface and a mating interface positioned proximate the port, at least a portion of the mounting segment extending along the mounting face of the housing for engagement with the printed circuit; and a clearance between the exterior surface of the mating segment and the opposing interior walls of the housing, the mating segment being movable within the interior cavity relative to each of the opposing interior walls via the clearance.

* * * * *